US009101037B2

(12) United States Patent
Cash

(10) Patent No.: US 9,101,037 B2
(45) Date of Patent: Aug. 4, 2015

(54) EMERGENCY LIGHTING BALLAST DEVICE WITH A PLURALITY OF BALLAST OUTPUTS FOR FLEXIBLE LAMP CONNECTION CONFIGURATIONS

(75) Inventor: Sean Cash, Germantown, TN (US)

(73) Assignee: KONIKLIJKE PHILIPS N.V., Eindhoven (NL)

( * ) Notice: Subject to any disclaimer, the term of this patent is extended or adjusted under 35 U.S.C. 154(b) by 1207 days.

(21) Appl. No.: 13/027,536

(22) Filed: Feb. 15, 2011

(65) Prior Publication Data

US 2012/0206044 A1 Aug. 16, 2012

(51) Int. Cl.
*H05B 41/14* (2006.01)
*H05B 41/292* (2006.01)

(52) U.S. Cl.
CPC ..... *H05B 41/292* (2013.01)

(58) Field of Classification Search
CPC ..... H02J 9/02; H05B 39/10
USPC ..... 315/86–87, 326; 362/540, 542
See application file for complete search history.

(56) References Cited

U.S. PATENT DOCUMENTS

| | | | | |
|---|---|---|---|---|
| 3,953,768 | A * | 4/1976 | Meredith et al. | 361/92 |
| 5,202,608 | A * | 4/1993 | Johnson | 315/86 |
| 5,434,478 | A | 7/1995 | Kovalsky et al. | |
| 5,814,971 | A * | 9/1998 | Johnson | 320/127 |
| 6,339,296 | B1 * | 1/2002 | Goral | 315/86 |
| 2002/0047627 | A1 * | 4/2002 | Pickering | 315/291 |
| 2003/0222603 | A1 * | 12/2003 | Mogilner et al. | 315/294 |
| 2004/0218384 | A1 * | 11/2004 | Newton et al. | 362/183 |
| 2005/0099144 | A1 | 5/2005 | Sanchez | |
| 2006/0025096 | A1 | 2/2006 | Jaffe et al. | |
| 2006/0220593 | A1 * | 10/2006 | Ball | 315/282 |
| 2008/0303449 | A1 * | 12/2008 | Ashikaga | 315/224 |
| 2009/0096387 | A1 * | 4/2009 | Fang et al. | 315/297 |
| 2010/0026196 | A1 * | 2/2010 | Miyazaki | 315/210 |

FOREIGN PATENT DOCUMENTS

WO 2009028290 A1 3/2009

* cited by examiner

*Primary Examiner* — Jason M Crawford
(74) *Attorney, Agent, or Firm* — Yuliya Mathis

(57) ABSTRACT

An emergency lighting ballast device includes a housing; a circuit disposed within the housing and configured to receive a battery supply voltage and to process the battery supply voltage for driving one or more fluorescent lamps; and at least three ballast outputs providing at an exterior of the housing, each ballast output being directly connected to a different electrical component of the circuit than the other ballast outputs and being configured to be selectively connected to the one or more fluorescent lamps to supply power from the circuit to the one or more fluorescent lamps.

16 Claims, 11 Drawing Sheets

EMERGENCY LIGHTING BALLAST DEVICE WITH A PLURALITY OF BALLAST OUTPUTS FOR FLEXIBLE LAMP CONNECTION CONFIGURATIONS

TECHNICAL FIELD

The present invention is directed generally to emergency lighting ballast devices. More particularly, various inventive methods and apparatus disclosed herein relate to an emergency lighting ballast device having a plurality of ballast outputs for flexible lamp connection configurations.

BACKGROUND

In many lighting systems, an alternating current (AC) ballast is used to deliver power from an AC power source, e.g. AC mains power (also referred to as line power or wall power or utility power) from the AC power grid, to one or more lighting devices (e.g., fluorescent lamps). In some systems, a so-called emergency lighting ballast device may be employed to supply power to the one or more lighting devices (e.g., lamps) power from the AC power source is lost.

FIG. 1 shows a functional block diagram of one example embodiment of a conventional lighting arrangement 10 including an AC mains ballast 15, a lamp 55, and an emergency lighting ballast device 101. FIG. 1 also shows a functional block diagram of one example of emergency lighting ballast device 101. As shown in FIG. 1, emergency lighting ballast device 101 includes an AC power outage detector 130, a back-up DC supply voltage (e.g., a battery 140), an inverter 150, a ballast 160, and relays 170 and 180. It should be understood that FIG. 1 shows a functional block diagram of only one exemplary embodiment of emergency lighting ballast device 101, and other configurations are possible. It should also be understood that emergency lighting ballast device 101 may include a number of additional components and/or functional blocks that are not illustrated in FIG. 1.

During a normal operating mode when AC mains power is available, AC power outage detector 130 detects the presence of an output voltage on AC ballast output lines 17 and controls relay 180 to connect the output voltage from AC mains ballast 15 across the terminals of the lamp 55 to supply power to lamp 55. Also during the normal operating mode, AC power outage detector 130 also controls relay 170 to disconnect the output of battery 140 from inverter 150, thereby conserving the charged state of battery 140.

In an "emergency" mode when AC mains power is lost, AC power outage detector 130 detects the absence of an output voltage on AC ballast output lines 17 and controls relay 170 to connect the output of battery 140 to inverter 150, thereby generating an emergency supply at the output of ballast 160. Also during the emergency mode, controls relay 180 to connect the emergency voltage output by ballast 160 across the terminals of the lamp 55 to supply power to lamp 55.

In some embodiments, in addition to or in place of detecting the presence or absence of an output voltage on AC ballast output lines 17, AC power outage detector 130 may detect the presence or absence of AC mains voltage directly, for example through the optional input 19 shown in FIG. 1. Due to the configuration shown in FIG. 1, an emergency lighting ballast device may be retrofitted into a lighting fixture that already includes an AC mains ballast and a lamp.

When designing the emergency lighting ballast device, a number of operating parameters are important, including the output power and output voltage supplied by the ballast. However, lighting systems may have a variety of different configurations and employ a variety of different lighting fixtures and lamps. The power requirements and/or start-up voltage requirements of one or more types of lamps employed in one lighting system may vary substantially from the requirements of one or more different types of lamps either within the same lighting system, or for a different lighting system. If an emergency lighting ballast device is employed that lacks an ability to be tailored to the lamp load to which it will be connected, lamp light output varies widely over the range of lamps operated. In this case, high power lamps would set the maximum load which the circuitry and the battery of the emergency lighting ballast device are capable of operating. This circuit and battery configuration means "smaller" lower power lamps are driven with less power, which means less light from the lamp. This is not ideal as the battery and circuit are capable of providing more power to these smaller lamps.

So it is desirable for an installer of an emergency lighting ballast device to be able to select the output power of the device to optimize the power delivered to a particular lamp. Furthermore, depending on the configuration, it may be desirable to provide the installer with an option for configuring an emergency lighting ballast device to drive either one lamp or two lamps (or more than two lamps, in some cases, if possible).

Thus, there is a need in the art for an emergency lighting ballast device which can be readily and flexibly configured to drive a variety of lamps and combinations of lamps.

SUMMARY

The present disclosure is directed to inventive methods and apparatus for an emergency lighting ballast device. For example, the present disclosure describes an emergency lighting ballast device that includes a plurality of ballast outputs that can support flexible lamp connection configurations to supply power to one or more lamps.

Generally, in one aspect, the invention relates to a device that includes a housing; a circuit disposed within the housing and configured to receive a battery supply voltage and to process the battery supply voltage for driving one or more fluorescent lamps; and at least three ballast outputs providing at an exterior of the housing, each ballast output being directly connected to a different electrical component of the circuit than the other ballast outputs and being configured to be selectively connected to the one or more fluorescent lamps to supply power from the circuit to the one or more fluorescent lamps.

According to one embodiment, the circuit employs a transformer, including a secondary winding having first and second ends; a first capacitor having a first end connected to the first end of the secondary winding of the transformer, and having a second end; and a second capacitor having a first end connected to the first end of the secondary winding of the transformer, and having a second end; and the at least three ballast outputs comprise: a first ballast output operatively connected to the second end of the secondary winding of the transformer; a second ballast output operatively connected to the second end of the first capacitor; and a third ballast output operatively connected to the second end of the second capacitor.

According to one optional feature of this embodiment, the one or more fluorescent lamps include one fluorescent lamp having first and second lamp terminals, wherein the first lamp terminal is connected to the first ballast output, and wherein the second lamp terminal is connected to the second ballast output, and wherein the third ballast output supplies no current to the fluorescent lamp.

According to another optional feature of this embodiment, the one or more fluorescent lamps include one fluorescent lamp having first and second lamp terminals, wherein the first lamp terminal is connected to the first ballast output, and wherein the second lamp terminal is connected to the second and third ballast outputs, wherein the second and third ballast outputs supply current to the fluorescent lamp.

According to another embodiment, the circuit includes at least one transformer, including a first secondary winding having first and second ends and a second secondary winding having first and second ends, wherein the second ends of the first and second secondary windings are connected to each other; a first capacitor having a first end connected to the first end of the first secondary winding, and having a second end; and a second capacitor having a first end connected to the first end of the second secondary winding, and having a second end; and the at least three ballast outputs comprise: a first ballast output operatively connected to the second end of the first secondary winding and the second end of the second secondary winding; a second ballast output operatively connected to the second end of the first capacitor; and a third ballast output operatively connected to the second end of the second capacitor.

According to yet another embodiment, the circuit includes at least one transformer, including a first secondary winding having first and second ends and a second secondary winding having first and second ends, wherein the second ends of the first and second secondary windings are connected to each other; a first capacitor having a first end connected to the first end of the first secondary winding, and having a second end; a second capacitor having a first end connected to the first end of the first secondary winding, and having a second end; a third capacitor having a first end connected to the first end of the second secondary winding, and having a second end; a fourth capacitor having a first end connected to the first end of the second secondary winding, and having a second end; and wherein the at least three ballast outputs comprise: a first ballast output operatively connected to the second end of the first secondary winding and the second end of the second secondary winding; a second ballast output operatively connected to the second end of the first capacitor; and a third ballast output operatively connected to the second end of the second capacitor; a fourth ballast output operatively connected to the second end of the third capacitor; and a fifth ballast output operatively connected to the second end of the fourth capacitor.

Generally, in another aspect, the invention relates to a device including a housing; a ballast disposed within the housing, wherein the ballast includes one or more transformers including one of more secondary windings, and a plurality of capacitors each having a first end connected to one of the one or more secondary windings and having a second end; and at least three ballast outputs providing at an exterior of the housing, wherein the at least three ballast outputs include a first ballast output operatively connected to at least one of the one or more secondary windings, and at least second and third ballast outputs each operatively connected to a corresponding one of the plurality of capacitors.

Generally, in yet another aspect, the invention focuses on a method that includes, for an emergency lighting ballast device having at least three ballast output wires and one or more fluorescent lamps each having electrical supply terminals, selecting a lamp connection configuration among a plurality of possible lamp connection configurations for connecting the emergency lighting ballast device to the one or more fluorescent lamps; determining connections between the ballast output wires and the electrical supply terminals of the one or more fluorescent lamps, according to the selected lamp connection configuration; and connecting the emergency lighting ballast device to the one or more fluorescent lamps using the determined connections.

The term "light source" should be understood to refer to any one or more of a variety of radiation sources, including, but not limited to, LED-based sources (including one or more LEDs), incandescent sources (e.g., filament sources, halogen sources), fluorescent sources, phosphorescent sources, high-intensity discharge sources (e.g., sodium vapor, mercury vapor, and metal halide sources), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s).

The term "lamp" should be interpreted to refer to a lighting unit that includes connector(s) for receiving electrical power and for generating radiation (e.g., visible light) from the received electrical power. Examples include bulbs and tubes, including incandescent bulbs, fluorescent bulbs, fluorescent tubes, LED bulbs, LED tubes, etc.

The term "lighting fixture" is used herein to refer to an implementation or arrangement of one or more lighting units (e.g., lamps) in a particular form factor, assembly, or package.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

As described above, it is desirable for an installer of an emergency lighting ballast device to be able to select the output power of the device to optimize the power delivered to a particular lamp. Furthermore, depending on the configuration, it may be desirable to provide the installer with an option for configuring the emergency lighting ballast device to drive either one lamp or two lamps (or more than two lamps, in some cases, if possible).

Figure 1:
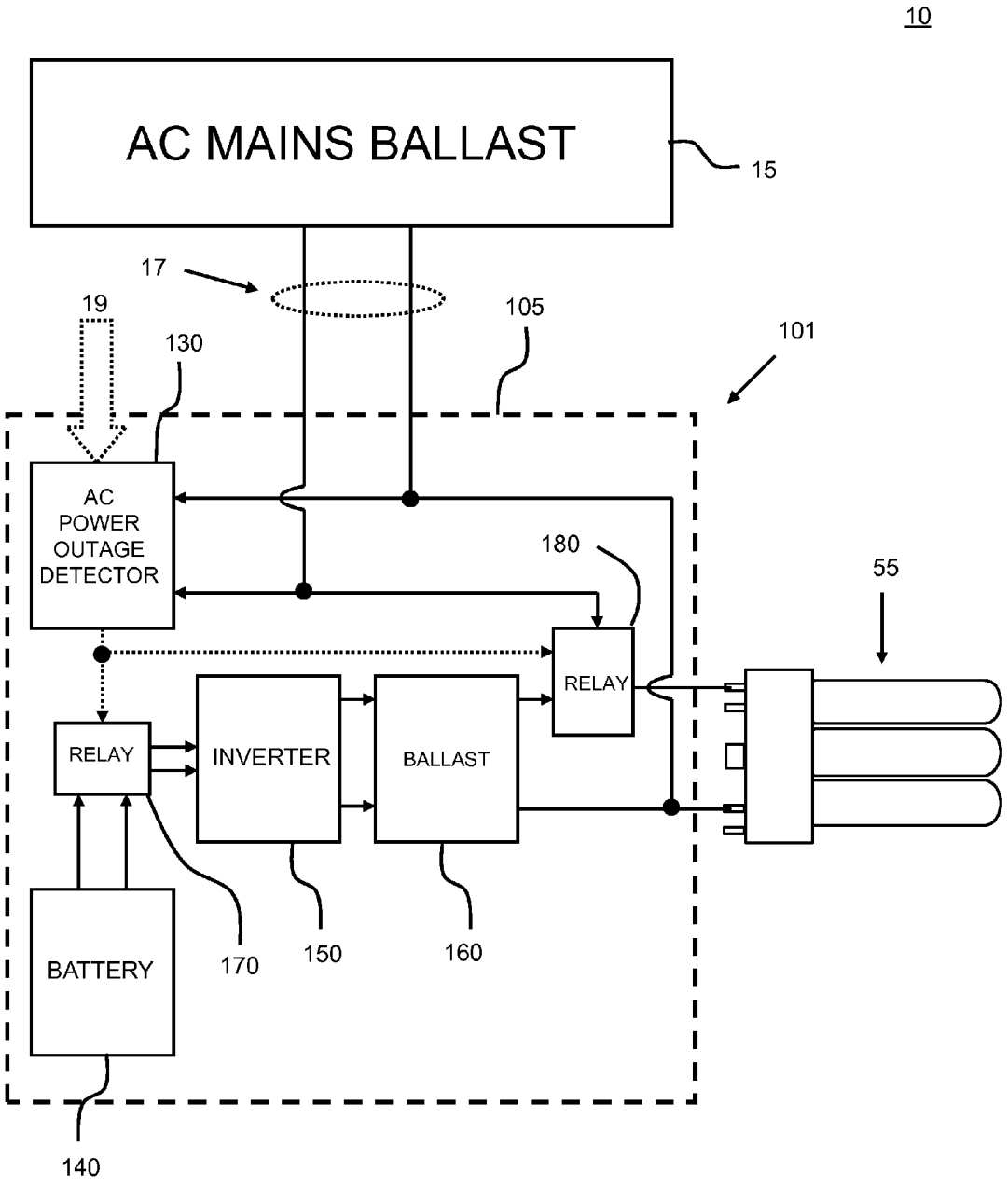
FIG. 1 (PRIOR ART)
FIG. 1 is a functional block diagram of on example of a lighting arrangement that includes an emergency lighting ballast device.
Figure 2A:
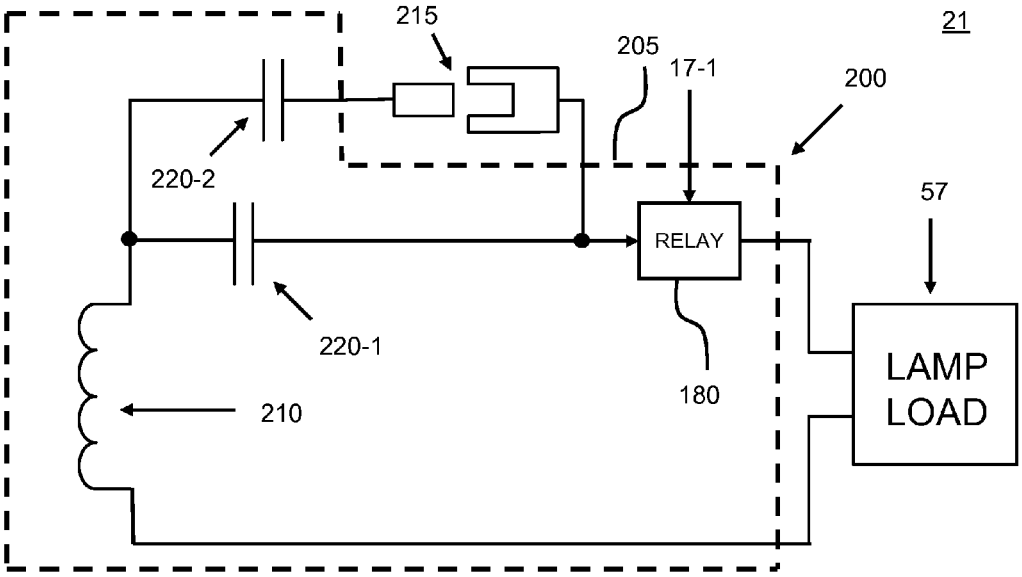
FIGS. 2A-B illustrate two examples of lighting arrangements that employ two different emergency lighting ballast devices that include an external configuration connector.

FIG. 2A illustrates an example of a lighting arrangement 21 that employs an emergency lighting ballast device 200 for supplying power to a lamp load 57, which may comprise one lamp, or two lamps connected in series or parallel. For simplicity of illustration, only a portion of the ballast of emergency lighting ballast device 200 is shown in FIG. 2A, from a secondary winding 210 of a ballast transformer to the ballast output. It should be understood that emergency lighting ballast device 200 may include a number of other components not shown in FIG. 2A (for example, components illustrated in FIG. 1), including a battery, an inverter, a primary winding of the ballast transformer and associated circuitry, etc. As shown in FIG. 2A, emergency lighting ballast device 200 includes a housing 205 which contains the secondary winding 210, a first capacitor 220-1, a second capacitor 220-2, and relay 180. An external configuration connector 215 is provided on the outside of housing 205.

During a normal operating mode when AC mains power is available, emergency lighting ballast device 200 supplies power to lamp load 57 from an external voltage generated from the AC mains, and relay 180 is controlled to connect the external voltage received on line 17-1 to the lamp load (for simplicity of illustration, the control signal for relay 180 is omitted in FIG. 2A). In an "emergency" mode when AC mains power is lost, relay 180 supplies power from the internal ballast of emergency lighting ballast device 200 to lamp load 57.

An installer may determine whether to connect configuration connector 215 or to leave configuration connector 215 unconnected based on the lamp load 57. Emergency lighting ballast device 200 is configured to supply more power to lamp load 57 in the emergency operating mode in a case where configuration connector 215 is closed or connected than in a case where configuration connector 215 is left open or unconnected.

Figure 2B:
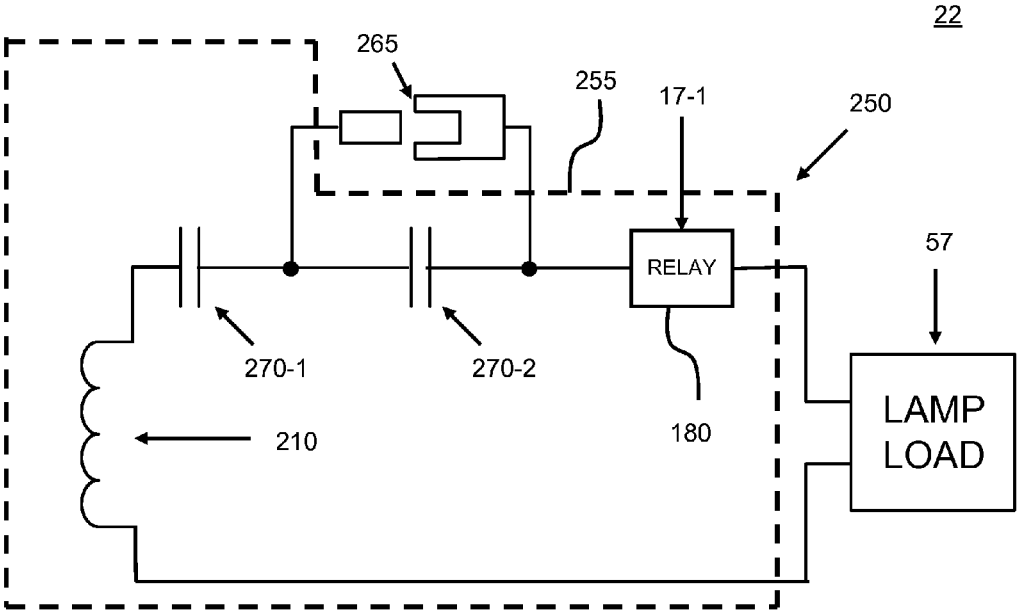

FIG. 2B illustrates an example of a lighting arrangement 22 that employs an emergency lighting ballast device 250 for supplying power to lamp load 57. As with FIG. 2A, for simplicity of illustration in FIG. 2B only a portion of the ballast of emergency lighting ballast device 250 is shown in FIG. 2B, from the secondary winding 210 of a ballast transformer to the ballast output. It should be understood that emergency lighting ballast device 250 may include a number of other components not shown in FIG. 2B (for example, components illustrated in FIG. 1), including a battery, an inverter, a primary winding of the ballast transformer and associated circuitry, etc. As shown in FIG. 2B, emergency lighting ballast device 250 includes a housing 255 which contains the secondary winding 210, a first capacitor 270-1, a second capacitor 270-2, and relay 180. An external configuration connector 265 is provided on the outside of housing 255.

The operation of emergency lighting ballast device 250 is similar to that of emergency lighting ballast device 200, with the major difference being that emergency lighting ballast device 250 is configured to supply more power to lamp load 57 in the emergency operating mode in a case where configuration connector 265 is open or unconnected than in a case where configuration connector 265 is closed or connected.

However, the arrangements shown in FIGS. 2A-B have certain drawbacks and limitations. Parallel fluorescent lamp operation is complicated by the negative impedance characteristic of fluorescent lamps. When a fluorescent lamp ignites, the voltage across that lamp's terminals decreases. These lamps require a certain voltage to allow the gas inside the lamp tube to ionize which allows the lamp to ignite. If two fluorescent lamps are connected directly in parallel with no control mechanism for each lamp individually, the first lamp to ignite will collapse the voltage across both lamps, which means the first lamp to ignite will be the only lamp to operate. Also, it would be desirable to be able to eliminate the external connector of the emergency lighting ballast devices 200 and 250.

And so. more generally, Applicants have recognized and appreciated that it would be beneficial to provide an emergency lighting ballast device which can be readily and flexibly configured to drive a variety of lamps and combinations of lamps.

In view of the foregoing, various embodiments and implementations of the present invention are directed to emergency lighting ballast device with a plurality of ballast outputs for flexible lamp connection configurations. In particular, embodiments of emergency lighting ballast devices will be described below wherein an output power and a configuration (e.g., single lamp or multiple lamps in parallel) can be selected simply by choosing appropriate connections between externally-supplied ballast outputs (e.g., wires) of the emergency lighting ballast device, and lamp terminals. The selection of the connections between the ballast outputs and the lamp terminals configures the voltage sources and ballasting circuit elements, which makes it possible to produce a more level range of light output as lamp size varies. Additionally, this allows for the operation of a single lamp or multiple lamps in parallel. In embodiments described below, the emergency lighting ballast device provides a separate ballasting element and corresponding ballast output for each lamp during the parallel operation of two, or more, lamps. When ballasting elements of an equal value are used, this can ensure that all lamps operate with (approximately) equal power. When a single lamp is used, the ballasting elements can be configured as necessary by an installer or end user by appropriate connections of the corresponding ballast outputs to drive this single lamp at the appropriate power level.

Figure 3:
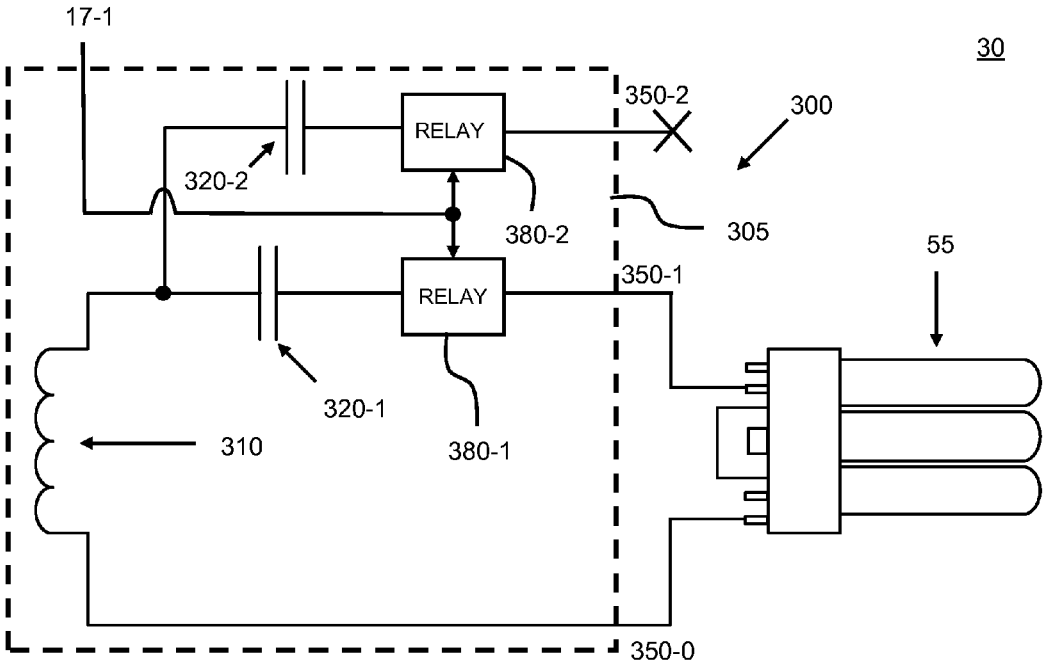
FIG. 3 illustrates a first embodiment of a lighting arrangement which includes a first embodiment of an emergency lighting ballast device having a plurality of outputs for flexible lamp connection configurations.

FIG. 3 illustrates a first embodiment of a lighting arrangement 30 which includes a first embodiment of an emergency lighting ballast device 300 having a plurality of outputs for flexible lamp connection configurations. For simplicity of illustration, only a portion of the ballast of emergency lighting ballast device 300 is shown in FIG. 3, from a secondary winding 310 of a ballast transformer to the ballast outputs. It should be understood that emergency lighting ballast device 300 may include a number of other components not shown in FIG. 3 (for example, components illustrated in FIG. 1), including a battery, an inverter, a primary winding of the ballast transformer and associated circuitry, etc.

As shown in FIG. 3, emergency lighting ballast device 300 includes a housing 305 which contains the secondary winding 310, a first capacitor 320-1, a second capacitor 320-2, and first and second relays 380-1 and 380-2. Secondary winding 310 has first and second ends. First capacitor 320-1 and second capacitor 320-2 each have first and second ends, with the first end of each capacitor connected to the first end of the secondary winding 310.

Emergency lighting ballast device 300 has three ballast outputs: a first ballast output 350-0 which is operatively connected to the second end of the secondary winding 310 of the transformer; a second ballast output 350-1 which is operatively connected (via relay 380-1) to the second end of first capacitor 320-1; and a third ballast output 350-2 which is operatively connected (via relay 380-2) to the second end of second capacitor 320-2. In some embodiments, each of the first, second and third ballast outputs 350-0, 350-1 and 350-2 may be an insulated wire having an end where the wire may be exposed for connection to a terminal of lamp 55 as desired for a particular lamp connection configuration.

In the arrangement shown in FIG. 3, the first, second, and third ballast outputs 350-0, 350-1, and 350-2 of emergency lighting ballast device 300 have been configured for supplying power to a single lamp 55 (e.g., a fluorescent lamp). In particular, first and second ballast outputs 350-0 and 350-1 are connected respectively to first and second lamp terminals of lamp 55, and third ballast output 350-2 is not connected to lamp 55 and supplies no current or power to lamp 55.

In arrangement 30, during a normal operating mode when AC mains power is available, emergency lighting ballast device 300 supplies power to lamp 55 from an external power source, and relay 380-1 is controlled to connect the external voltage received on line 17-1 to lamp 55 (for simplicity of illustration, the control signal for relay 380-1 is omitted in FIG. 3). In an "emergency" mode when AC mains power is lost, relay 380-1 supplies power from the internal ballast of emergency lighting ballast device 300 to lamp 55.

Figure 4:
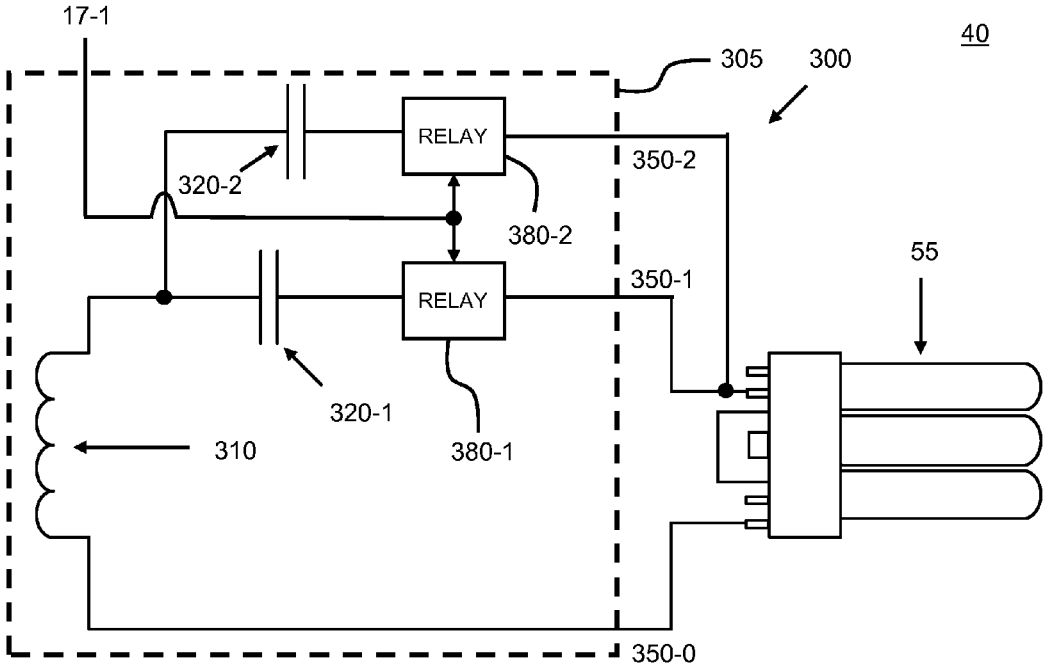
FIG. 4 illustrates a second embodiment of a lighting arrangement which includes the first embodiment of an emergency lighting ballast device having a plurality of outputs for flexible lamp connection configurations.

FIG. 4 illustrates a second embodiment of a lighting arrangement 40 which includes the first embodiment of the emergency lighting ballast device 300 having a plurality of outputs for flexible lamp connection configurations.

In arrangement 40, during a normal operating mode when AC mains power is available, emergency lighting ballast device 300 supplies power to lamp 55 from an external power source, and relays 380-1 and 380-2 are controlled to connect the external voltage received on line 17-1 to lamp 55 (for simplicity of illustration, the control signal for relays 380-1 and 380-2 are omitted in FIG. 4). In an "emergency" mode when AC mains power is lost, relays 380-1 and 380-2 supply power from the internal ballast of emergency lighting ballast device 300 to lamp 55.

The arrangement 40 is similar to the arrangement 30 described above, except that in arrangement 40 first ballast output 350-0 is connected to the first lamp terminal of lamp 55, and second and third ballast outputs 350-1 and 350-2 are both connected to the second lamp terminal of lamp 55. Accordingly, by this configuration emergency lighting ballast device 300 can supply more power to lamp 55 than in the lighting arrangement 30. That is, the connections of ballast outputs 350-0, 350-1 and 350-2 shown in arrangement 30 may be employed when lamp 55 is a low power lamp, and the connections of ballast outputs 350-0, 350-1 and 350-2 shown in arrangement 40 may be employed when lamp 55 is a high power lamp.

In general, the current through lamp 55 is a function of the voltage applied to the ballasting elements, the frequency of oscillation of that voltage, and the value of the ballasting element (first and second capacitors 320-1 and 320-2 as shown in FIGS. 3 and 4). This function is given as:

$$I(55)=V*2*PI*f*C \tag{1}$$

where: I(55) is the current through the ballasting elements and the current through lamp 55; V is the voltage across the ballasting elements; f is the frequency of the applied voltage V; and C is the total value of the capacitance of the ballasting elements.

Since only first capacitor 320-1 acts as a ballasting element in the arrangement 30 of FIG. 3, the current through lamp 55 is:

$$I(55)=V*2*PI*f*C1 \tag{2}$$

where C1 is the capacitance of first capacitor 320-1.

Since the total circuit capacitance value for two parallel capacitors is simply the sum of the value of the two capacitors, the lamp current in the arrangement 40 of FIG. 4 is:

$$I=V*2*PI*f*(C1+C2) \tag{3}$$

where C2 is the capacitance of second capacitor 320-2.

For the case where C1=C2, the value of the current supplied by emergency lighting ballast device 300 to lamp 55 in arrangement 40 is twice the current supplied by emergency lighting ballast device 300 to lamp 55 in arrangement 30.

Figure 5:
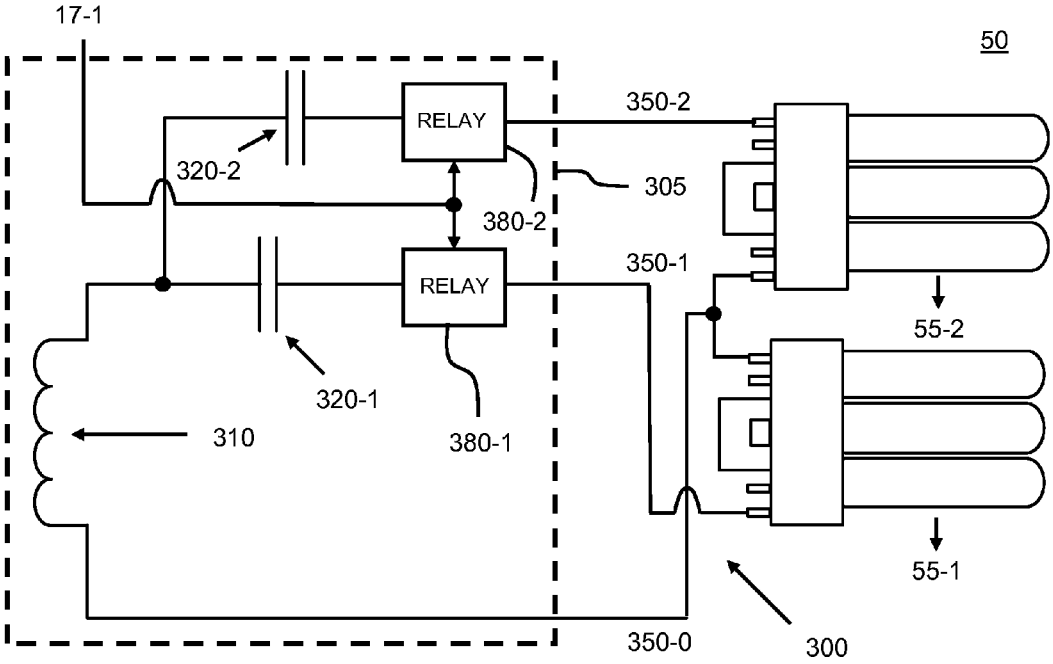
FIG. 5 illustrates a third embodiment of a lighting arrangement which includes the first embodiment of an emergency lighting ballast device having a plurality of outputs for flexible lamp connection configurations.

FIG. 5 illustrates a third embodiment of a lighting arrangement 50 which includes the first embodiment of the emergency lighting ballast device 300 having a plurality of outputs for flexible lamp connection configurations.

The arrangement 50 is similar to the arrangements 30 and 40 described above, except that in arrangement 50 emergency lighting ballast device 300 supplies power to first and second lamps 55-1 and 55-2 (e.g., fluorescent lamps). In particular: second ballast output 350-1 is connected to the first lamp terminal of first lamp 55-1; third ballast output 350-2 is connected to the first lamp terminal of second lamp 55-2; and first ballast output 350-0 is connected to the second lamp terminals of first and second lamps 55-1 and 55-2. Accordingly, by this configuration emergency lighting ballast device 300 can supply power to two lamps 55-1 and 55-2.

For arrangement 50, the currents I(55-1) and I(55-2) supplied to first and second lamps 55-1 and 55-2, respectively, are:

$$I(55\text{-}1)=V*2*PI*f*C1 \quad (4)$$

$$I(55\text{-}2)=V*2*PI*f*C2. \quad (5)$$

In the case where the capacitance of first capacitor 320-1 (C1) equals the capacitance of second capacitor 320-2 (C2), then the current through each lamp 55-1 and 55-2 is the same as the current through a single lamp 55 in arrangement 30.

As shown in FIGS. 3-5, emergency lighting ballast device 300 has several possible lamp connection configurations which can be employed, depending on the number and type of lamp(s) to be supplied by emergency lighting ballast device 300. During installation, based upon the lamp(s) (e.g., fluorescent lamps(s)) to be supplied power by emergency lighting ballast device 300, an installer may: select a lamp connection configuration among a plurality of possible lamp connection configurations for connecting emergency lighting ballast device 300 to the lamp(s); determine connections between the ballast outputs and the electrical supply terminals of the lamp (s) according to the selected lamp connection configuration; and connect emergency lighting ballast device 300 to the lamp(s) using the determined connections.

A second embodiment of an emergency lighting ballast device 600 is described below with respect to FIGS. 6-8 in which the ballast employs two transformers, where the tranformers' primary windings are arranged in parallel in a manner similar to that as described in U.S. Pat. No. 5,811,938. However, unlike the arrangement disclosed in U.S. Pat. No. 5,811,938, the transformer secondary windings are handled differently according to the different lamp connection configurations of the emergency lighting ballast device as described below with respect to FIGS. 6-8.

Figure 6:
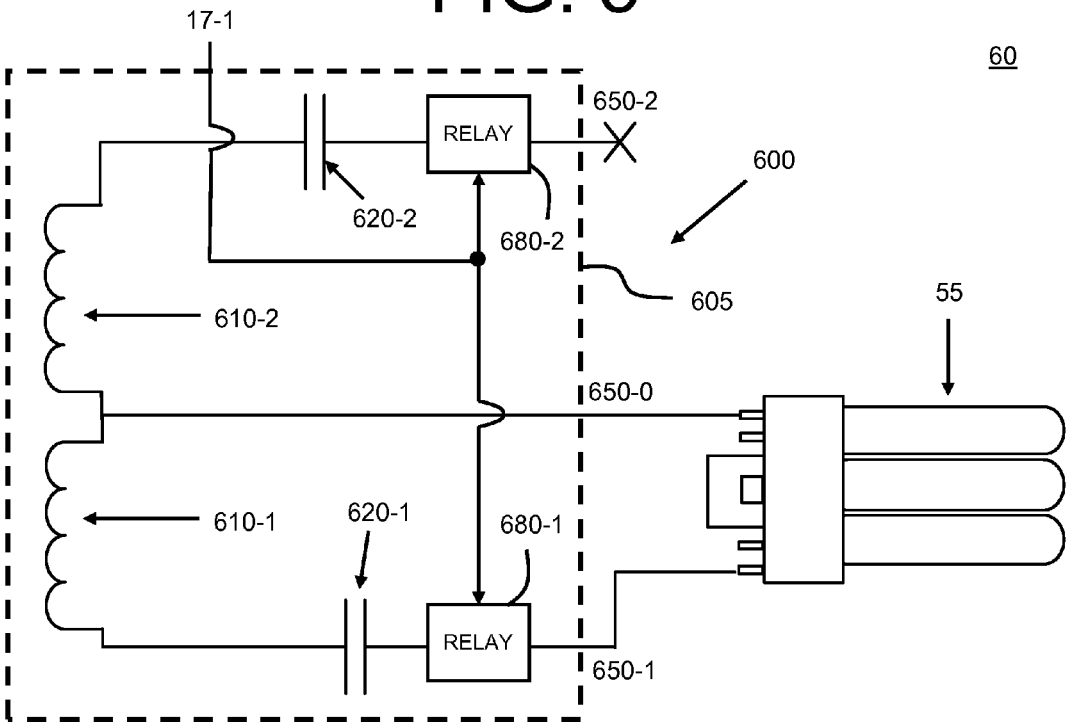
FIG. 6 illustrates a fourth embodiment of a lighting arrangement which includes a second embodiment of an emergency lighting ballast device having a plurality of outputs for flexible lamp connection configurations.

FIG. 6 illustrates a fourth embodiment of a lighting arrangement 60 which includes the emergency lighting ballast device 600 having a plurality of outputs for flexible lamp connection configurations. For simplicity of illustration, only a portion of the ballast of emergency lighting ballast device 600 is shown in FIG. 6, from first and second secondary windings 610-1 and 610-2 of one or more ballast transformers, to the ballast outputs. It should be understood that emergency lighting ballast device 600 may include a number of other components not shown in FIG. 6 (for example, components illustrated in FIG. 1), including a battery, an inverter, one or more primary windings of one or more ballast transformers and associated circuitry, etc.

As shown in FIG. 6, emergency lighting ballast device 600 includes a housing 605 which contains first and second secondary windings 610-1 and 610-2 connected in series with each other, a first capacitor 620-1, a second capacitor 620-2 and first and second relays 680-1 and 680-2. Secondary windings 610-1 and 610-2 each have first and second ends, where the second ends of first and second secondary windings 610-1 and 610-2 are connected to each other. First capacitor 620-1 has first and second ends, with the first end connected to the first end of the first secondary winding 610-1, and second capacitor 620-2 has first and second ends, with the first end connected to the first end of the second secondary winding 610-2.

Emergency lighting ballast device 600 has three ballast outputs: a first ballast output 650-0 which is operatively connected to the second ends of the first and second secondary windings 610-1 and 610-2; a second ballast output 650-1 which is operatively connected (via relay 680-1) to the second end of first capacitor 620-1; and a third ballast output 650-2 which is operatively connected (via relay 680-2) to the second end of second capacitor 620-2. In some embodiments, each of the first, second and third ballast outputs 650-0, 650-1 and 650-2 may be an insulated wire having an end where the wire may be exposed for making an electrical connection to a terminal of lamp 55, as desired for a particular lamp connection configuration.

In the arrangement shown in FIG. 6, the first, second, and third ballast outputs 650-0, 650-1, and 650-2 of emergency lighting ballast device 600 have been configured for supplying power to a single lamp 55 (e.g., a fluorescent lamp) (e.g., a low power lamp). In particular, first and second ballast outputs 650-0 and 650-1 are connected respectively to first and second lamp terminals of lamp 55, and third ballast output 650-2 is not connected to lamp 55 and supplies no current or power to lamp 55.

In arrangement 60, during a normal operating mode when AC mains power is available, emergency lighting ballast device 600 supplies power to lamp 55 from an external power source, and relay 680-1 is controlled to connect the external voltage received on line 17-1 to lamp 55 (for simplicity of illustration, the control signal for relay 680-1 is omitted in FIG. 6). In an "emergency" mode when AC mains power is lost, relay 680-1 supplies power from the internal ballast of emergency lighting ballast device 600 supplies to lamp 55.

Figure 7:
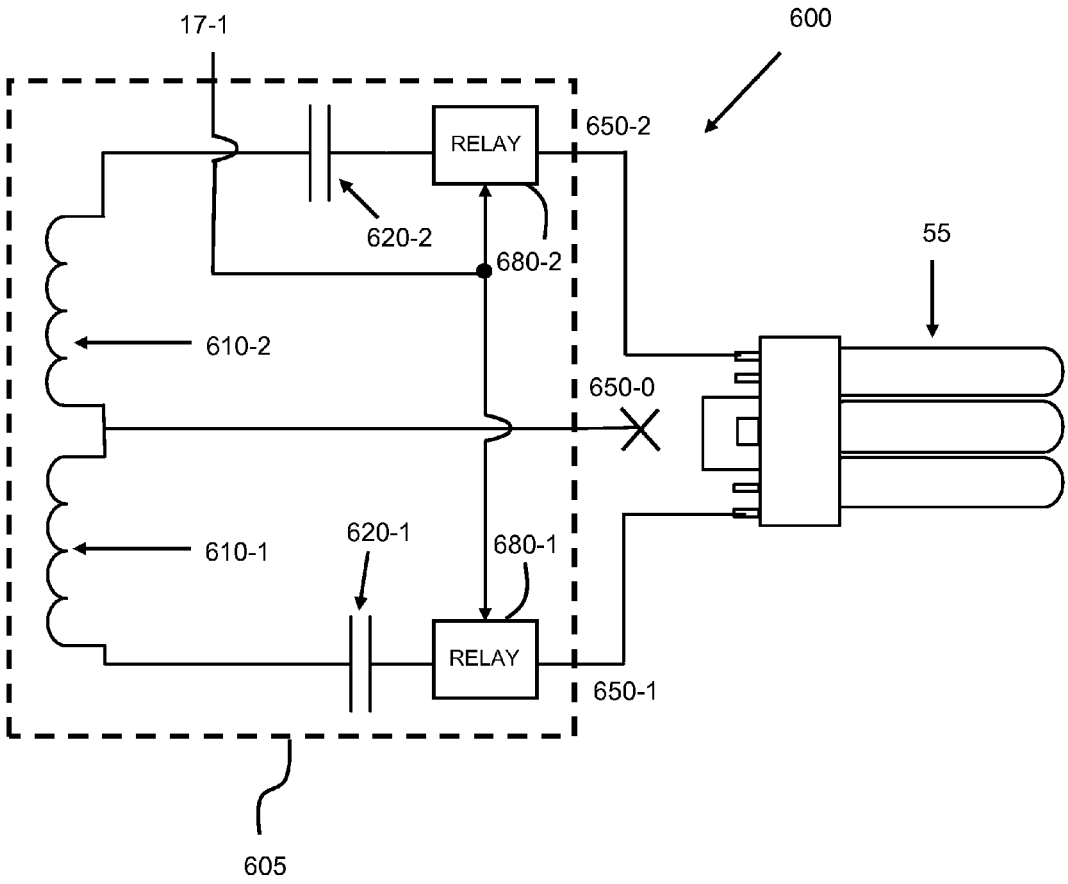
FIG. 7 illustrates a fifth embodiment of a lighting arrangement which includes the second embodiment of an emergency lighting ballast device having a plurality of outputs for flexible lamp connection configurations.

FIG. 7 illustrates a fifth embodiment of a lighting arrangement 70 which includes the second embodiment of the emergency lighting ballast device 600 having a plurality of outputs for flexible lamp connection configurations.

In arrangement 70, during a normal operating mode when AC mains power is available, emergency lighting ballast device 600 supplies power to lamp 55 from an external power source, and relays 680-1 and 680-2 are controlled to connect the external voltage received on line 17-1 to lamp 55 (for simplicity of illustration, the control signal for relays 680-1 and 680-2 are omitted in FIG. 7). In an "emergency" mode when AC mains power is lost, relays 680-1 and 680-2 supply power from the internal ballast of emergency lighting ballast device 600 to lamp 55.

The arrangement 70 is similar to the arrangement 60 described above, except that in arrangement 70 second ballast output 650-1 is connected to the first lamp terminal of lamp 55, and third ballast output 650-2 is connected to the second lamp terminal of lamp 55, while first ballast output 650-0 is not connected to lamp 55 and supplies no current or power to lamp 55.

In arrangement 70, when a single high power lamp is used, the transformer secondary windings 610-1 and 620-1 are connected in series. This arrangement doubles the output voltage provided by emergency lighting ballast device 600 (compared to the arrangement 60 of FIG. 6), which is required to strike a larger fluorescent lamp, but places the first and second capacitors 620-1 and 620-2 in series, which halves the value of the ballasting capacitance, thus reducing the power to lamp 55. When the capacitance of first capacitor 620-1 is C1 and the capacitance of second capacitor 620-2 is C2:

$$I=2*V*2*PI*f*(C1*1/2) \quad (6)$$

As can be seen from equation (6), when the applied voltage is doubled yet the capacitance is halved, the load current on emergency lighting ballast device 600 in arrangement 70 remains the same as it is in arrangement 60. This allows larger lamps to be ignited yet maintain the same load current, which can be important when emergency lighting ballast device 600 is powered by a battery (see, e.g., FIG. 1), and the battery current must be limited to certain maximum levels to meet run time requirements.

Figure 8:
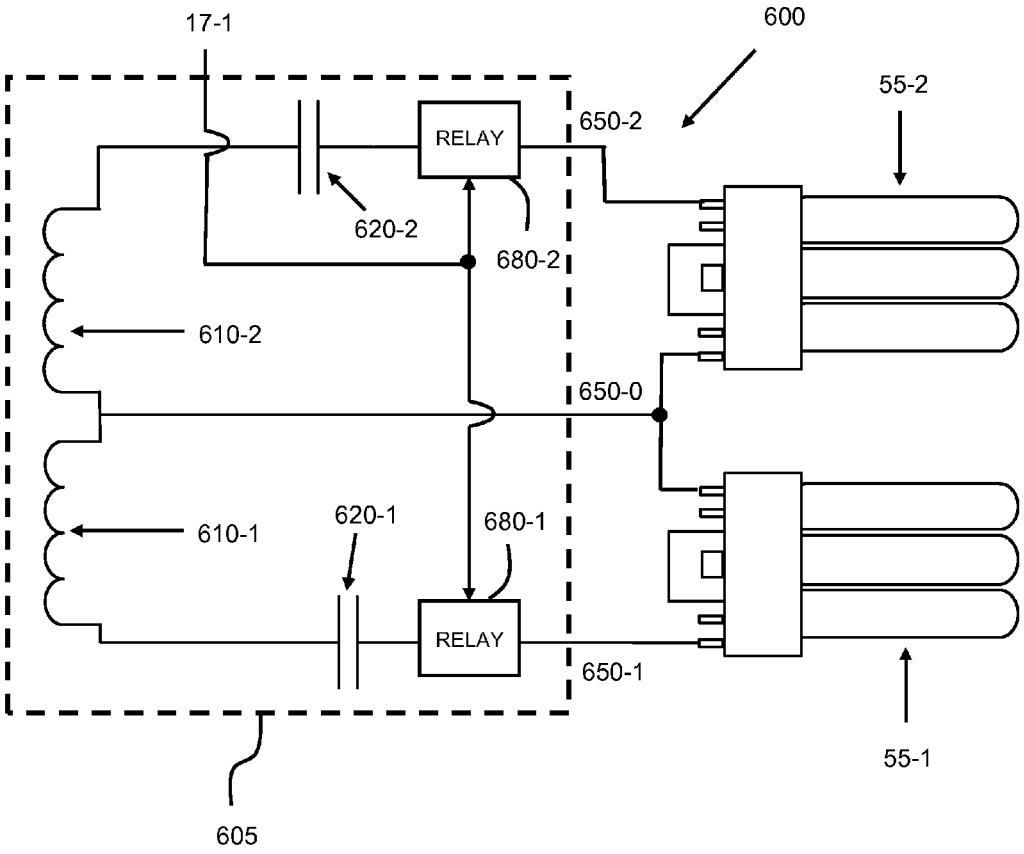
FIG. 8 illustrates a sixth embodiment of a lighting arrangement which includes the second embodiment of an emergency lighting ballast device having a plurality of outputs for flexible lamp connection configurations.

FIG. 8 illustrates a sixth embodiment of a lighting arrangement 80 which includes the second embodiment of the emergency lighting ballast device 600 having a plurality of outputs for flexible lamp connection configurations.

The arrangement 80 is similar to the arrangements 60 and 70 described above, except that in arrangement 80 emergency lighting ballast device 600 supplies power to first and second lamps 55-1 and 55-2 (e.g., fluorescent lamps). In particular: second ballast output 650-1 is connected to the first lamp terminal of first lamp 55-1; third ballast output 650-2 is connected to the first lamp terminal of second lamp 55-2; and first ballast output 650-0 is connected to the second lamp terminals of first and second lamps 55-1 and 55-2. Accordingly, by this configuration, each transformer secondary winding 610-1 and 610-2 is individually ballasting one of the two lamps 55-1 and 55-2.

Emergency lighting ballast device 600 may have an advantage with respect to emergency lighting ballast device 300 in that it allows higher power lamps to be struck, since, as illustrated particularly in FIG. 7, the open circuit output voltage can be approximately double that of the arrangements 20, 30 and 40 (for equivalent transformers). However, the size and cost of the circuit may be increased for emergency lighting ballast device 600, since two transformers are employed.

The arrangements described above illustrate emergency lighting ballast devices for selectively supplying power to one or two lamps (e.g., fluorescent lamps). However, in other embodiments, more than two lamps could be placed in parallel.

Figure 9:
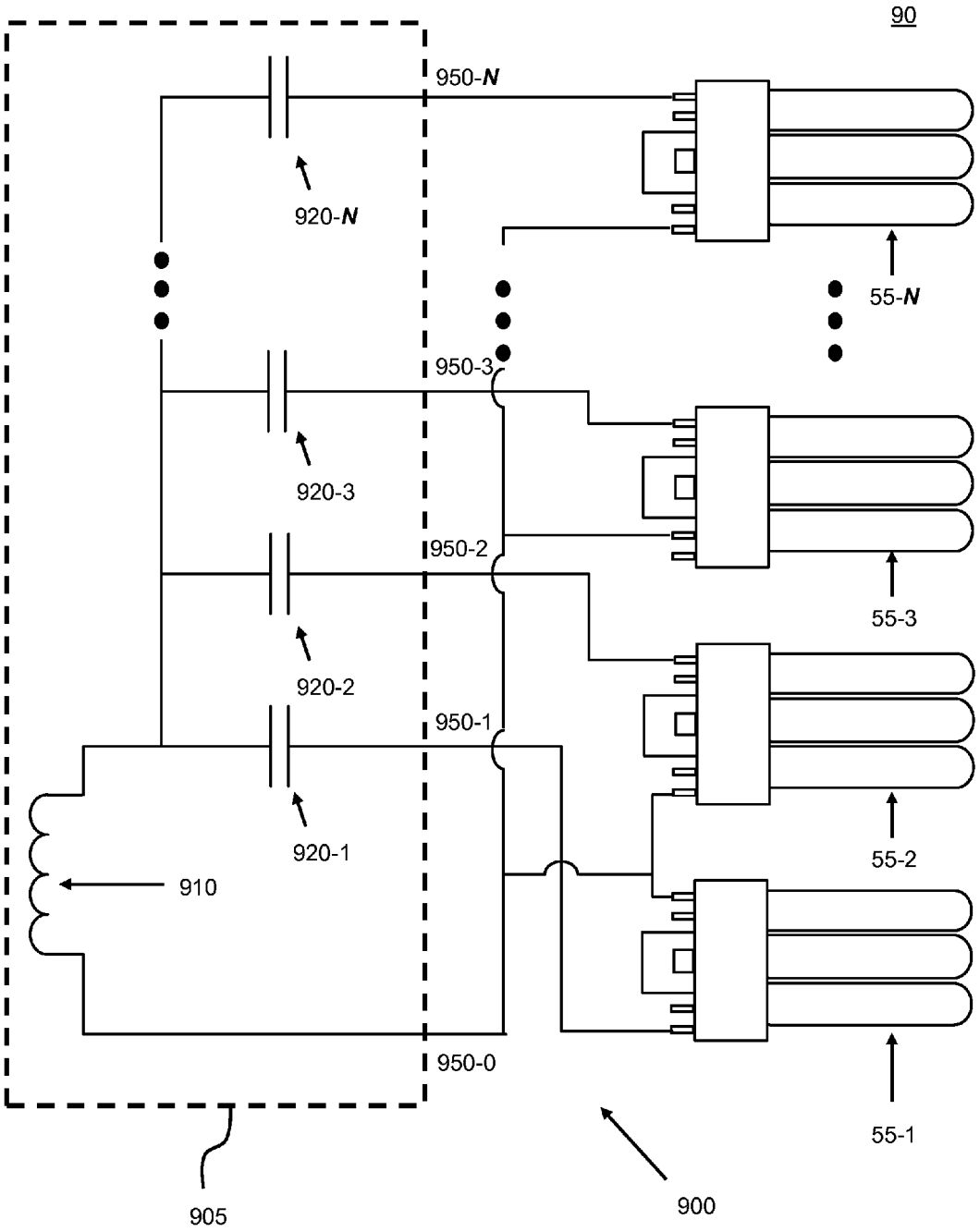
FIG. 9 illustrates a seventh embodiment of a lighting arrangement which includes a third embodiment of an emergency lighting ballast device having a plurality of outputs for flexible lamp connection configurations.

FIG. 9 illustrates a seventh embodiment of a lighting arrangement 90 which includes a third embodiment of an emergency lighting ballast device 900 having a plurality of outputs for flexible lamp connection configurations for supplying power to N (N>2) lamps 55-1~55-N in parallel. For simplicity of illustration, only a portion of the ballast of emergency lighting ballast device 900 is shown in FIG. 9, from secondary winding 910 of a ballast transformer, to the ballast outputs. It should be understood that emergency lighting ballast device 900 may include a number of other components not shown in FIG. 9 (for example, components illustrated in FIG. 1), including a battery, an inverter, one or more primary windings of one or more ballast transformers and associated circuitry, etc.

As shown in FIG. 9, emergency lighting ballast device 900 includes a housing 905 which contains a secondary winding 910, first through N capacitors 920-1~920-N, and a plurality of internal relays (for simplicity of illustration, not shown in FIG. 9). Secondary winding 910 has first and second ends. First through N capacitors 920-1~920-N each have first and second ends, with the first end of each capacitor connected to the first end of the secondary winding 910.

Emergency lighting ballast device 900 has N+1 ballast outputs: a first ballast output 950-0 operatively connected to the second end of the secondary winding 910, and second through Nth ballast outputs 950-1 through 950-N each operatively connected (e.g., via a corresponding relay) to a second end of a corresponding one of the N capacitors 920-1~920-N. In some embodiments, each of the ballast outputs 950-0~950-N may be an insulated wire having an end where the wire may be exposed for making an electrical connection to a terminal of one of the lamps 55-1~55-N, as desired for a particular lamp connection configuration.

In the arrangement shown in FIG. 9, the single secondary winding 910 and the N ballasting elements (e.g., capacitors) are configured to supply power to N lamps 55-1~55-N via the N+1 ballast outputs 950-0~950-N. In particular, FIG. 9 illustrates an arrangement 90 where first ballast output 950-0 is connected to a first lamp terminal of each of the lamps 55-1~55-N, and the second through Nth ballast outputs 950-1 through 950-N are each connected to a second lamp terminal of a corresponding one of the lamps 55-1~55-N.

In arrangement 90, during a normal operating mode when AC mains power is available, emergency lighting ballast device 900 supplies power to lamps 55-1~55-N from an external power source, and internal relays are controlled to connect an external voltage generated from the AC mains to lamps 55-1~55-N. In an "emergency" mode when AC mains power is lost, the internal relays supply power from the internal ballast of emergency lighting ballast device 900 to lamps 55-1~55-N.

In alternatives to arrangement 90, the N ballast outputs 950-0~950-N of emergency lighting ballast device 900 could be used to incrementally increase the output power for a single lamp, or any combination of lamps up to the number of additional output wires, N. For example, consider the case where N+1=7 output wires 950-0~950-6 are present, and the total power output available from emergency lighting ballast device 900 is 12 watts.

In that case, Table 1 below lists a set of possible configurations for emergency lighting ballast device 900.

TABLE 1

| x | n | Power Multiplier | P |
|---|---|---|---|
| 1 | 6 | 1 | 12 |
| 2 | 3 | ½ | 6 |
| 3 | 2 | ⅓ | 4 |
| 6 | 1 | ⅙ | 2 |

where: n=number of ballast outputs per lamp (not including the common ballast output 950-0); x=number of lamps; and P=power supplied to each lamp.

The cases where there are four or five lamps are used not shown in Table 1, since there could not be an equal number of ballast outputs for each lamp. However, these cases are possible in a configuration where the applied power level (and thus the light intensity) is not required to be the same for each lamp.

Figure 10:
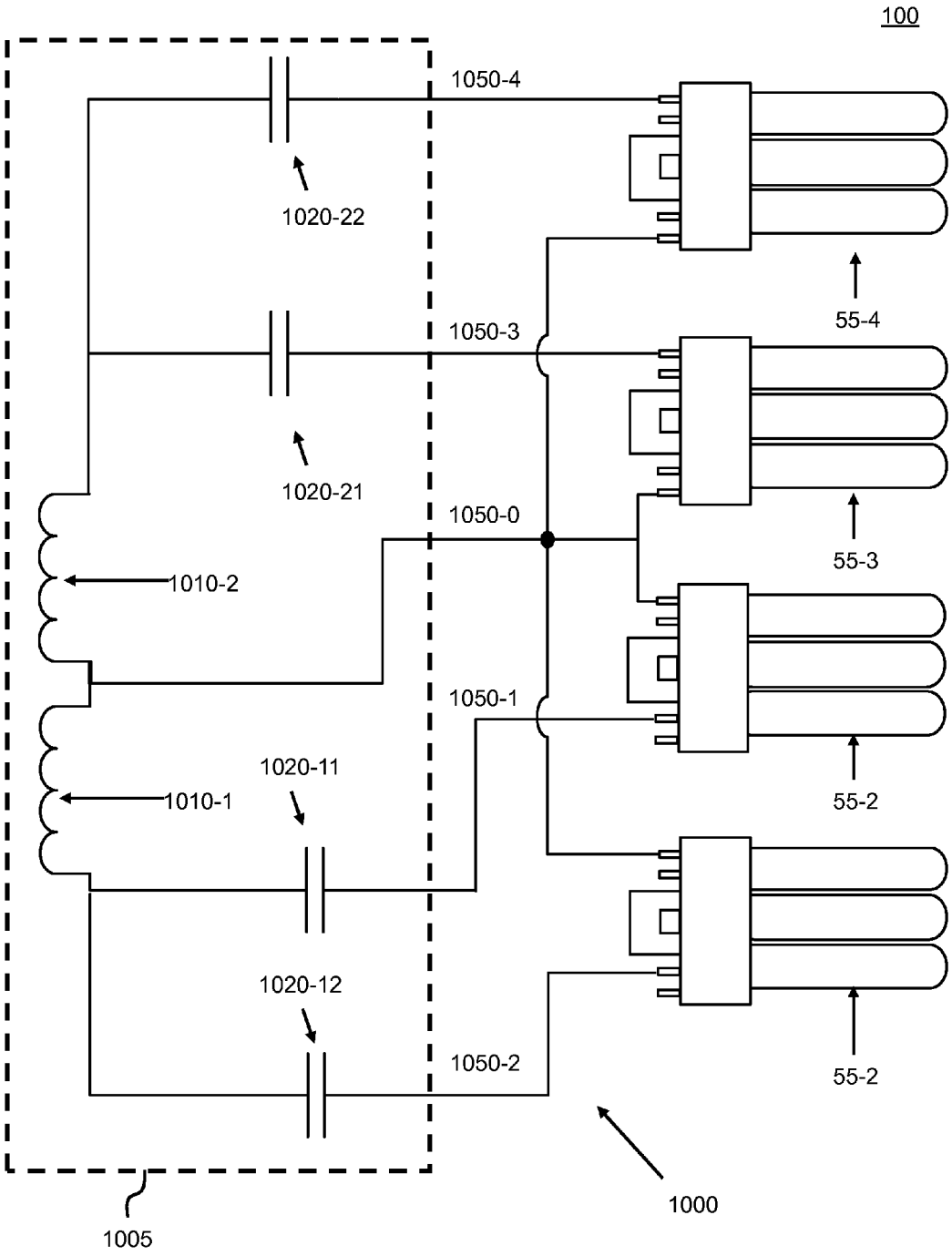
FIG. 10 illustrates a fourth embodiment of a lighting arrangement which includes a fourth embodiment of an emergency lighting ballast device having a plurality of outputs for flexible lamp connection configurations.

FIG. 10 illustrates a fourth embodiment of a lighting arrangement 100 which includes a fourth embodiment of an emergency lighting ballast device 1000 having a plurality of outputs for flexible lamp connection configurations. For simplicity of illustration, only a portion of the ballast of emergency lighting ballast device 1000 is shown in FIG. 10, from first and second secondary windings 1010-1 and 1010-2 of one or more ballast transformers, to the ballast output. It should be understood that emergency lighting ballast device 1000 may include a number of other components not shown in FIG. 10 (for example, components illustrated in FIG. 1), including a battery, an inverter, one or more primary windings of one or more ballast transformers and associated circuitry, etc.

As shown in FIG. 10, emergency lighting ballast device 1000 includes a housing 1005 which contains first and second secondary windings 1010-1 and 1010-2 connected in series with each other, a first capacitor 1020-11, a second capacitor 1020-12, a third capacitor 1020-21, a fourth capacitor 1020-22, and relays (for simplicity of illustration, not shown in FIG. 10). Secondary windings 1010-1 and 1010-2 each have first and second ends, where the second ends of first and second secondary windings 1010-1 and 1010-2 are connected to each other. First and second capacitors 1020-11 and 1020-12 each have first and second ends, with the first ends connected to the first end of the first secondary winding 1010-1, and third and fourth capacitors 1020-21 and 1020-22 each have first and second ends, with the first ends connected to the first end of the second secondary winding 1010-2.

Emergency lighting ballast device 1000 has five ballast outputs: a first ballast output 1050-0 which is operatively connected to the second ends of the first and second secondary windings 1010-1 and 1010-2; a second ballast output 1050-1 which is operatively connected (e.g., via a corresponding relay) to the second end of first capacitor 1020-11; a third ballast output 1050-2 which is operatively connected (e.g., via a corresponding relay) to the second end of second capacitor 1020-12; a fourth ballast output 1050-3 which is operatively connected (e.g., via a corresponding relay) to the second end of third capacitor 1020-21; and a fifth ballast output 1050-4 which is operatively connected (e.g., via a corresponding relay) to the second end of fourth capacitor 1020-22. In some embodiments, each of the ballast outputs 1050-0~1050-4 may be an insulated wire having an end where the wire may be exposed for making an electrical connection to a terminal of lamp 55, as desired for a particular lamp connection configuration.

In the arrangement shown in FIG. 10, the first through fifth ballast outputs 1050-0~1050-4 of emergency lighting ballast device 1000 have been configured for supplying power to four lamps 55-1~55-4 (e.g., fluorescent lamps). In particular, each of the ballast outputs 1050-1~1050-4 of emergency lighting ballast device 1000 are connected to a first terminal of a corresponding one of the lamps 55-1~55-4, and ballast output 1050-0 is connected to the second terminals of all of the lamps 55-1~55-4.

In arrangement 100, during a normal operating mode when AC mains power is available, emergency lighting ballast device 1000 supplies power to lamps 55-1~55-4 from an external power source, and internal relays are controlled to connect an external voltage generated from the AC mains to lamps 55-1~55-4. In an "emergency" mode when AC mains power is lost, the internal relays supply power from the internal ballast of emergency lighting ballast device 1000 to lamps 55-1~55-4.

Figure 11:
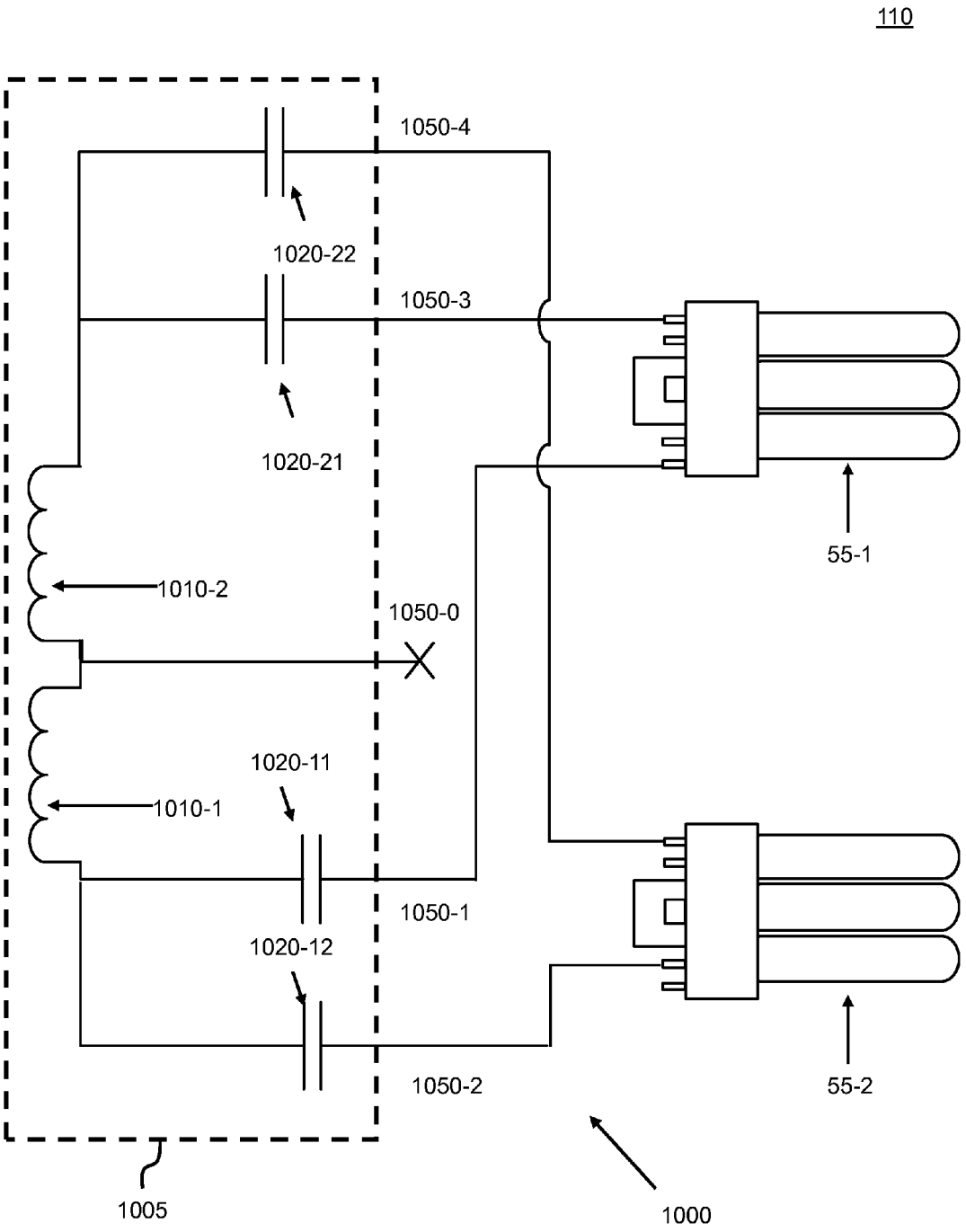
FIG. 11 illustrates a fifth embodiment of a lighting arrangement which includes the fourth embodiment of an emergency lighting ballast device having a plurality of outputs for flexible lamp connection configurations.

FIG. 11 illustrates a fifth embodiment of a lighting arrangement 110 which includes the fourth embodiment of the emergency lighting ballast device 1000 having a plurality of outputs for flexible lamp connection configurations.

The arrangement 110 is similar to the arrangement 100 described above, except that arrangement 110 includes only two lamps 55-1 and 55-2, and in arrangement 110: second ballast output 1050-1 is connected to the first lamp terminal of lamp 55-1, and fourth ballast output 1050-3 is connected to the second lamp terminal of lamp 55-1; third ballast output 1050-2 is connected to the first lamp terminal of lamp 55-2, and fifth ballast output 1050-4 is connected to the second lamp terminal of lamp 55-2; and first ballast output 1050-0 is not connected to lamp 55-1 or lamp 55-2 and supplies no current or power to lamp 55-1 or lamp 55-2.

Figure 12:
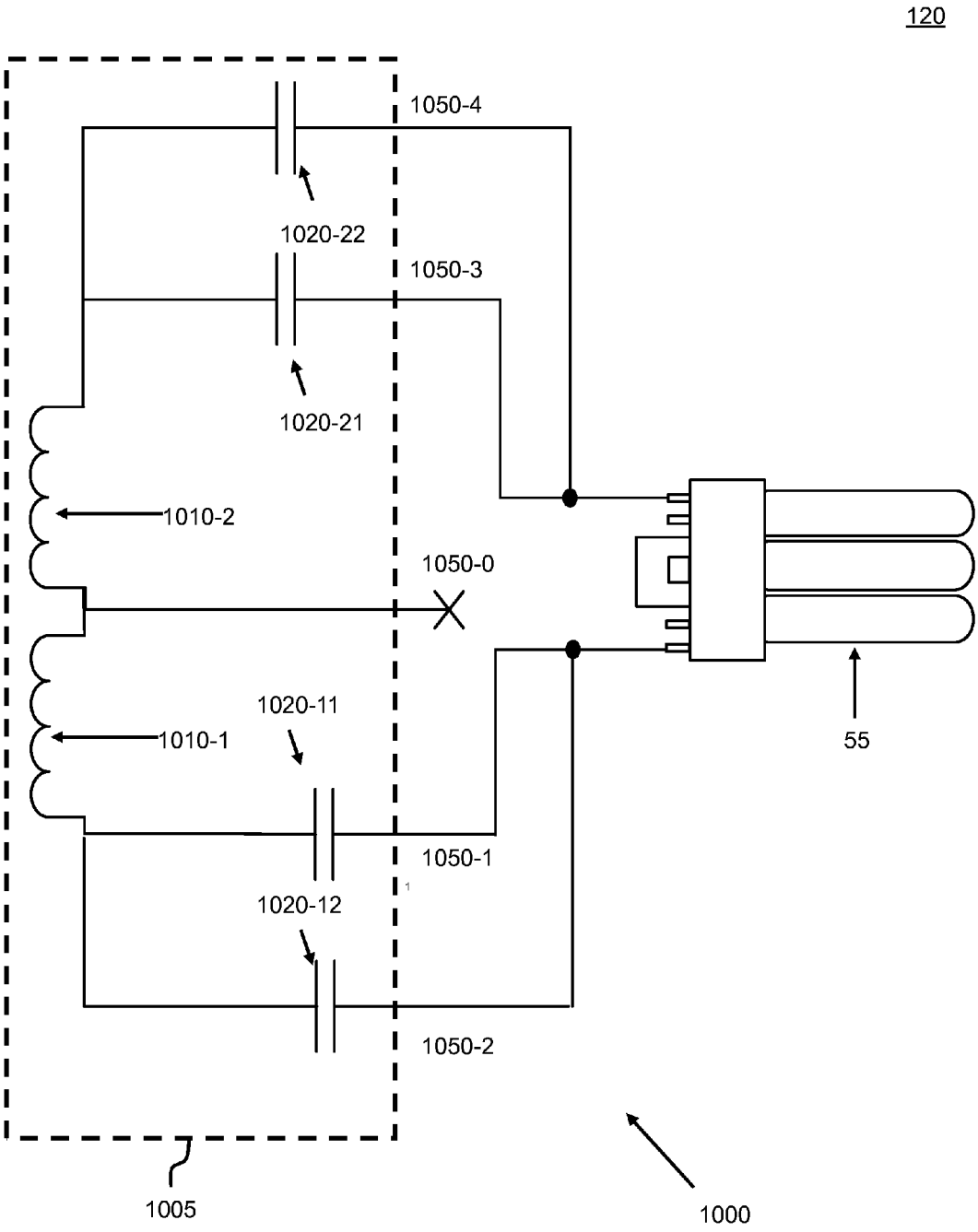
FIG. 12 illustrates a sixth embodiment of a lighting arrangement which includes the fourth embodiment of an emergency lighting ballast device having a plurality of outputs for flexible lamp connection configurations.

FIG. 12 illustrates a sixth embodiment of a lighting arrangement 120 which includes the fourth embodiment of the emergency lighting ballast device 1000 having a plurality of outputs for flexible lamp connection configurations.

The arrangement 120 is similar to the arrangements 100 and 110 described above, except that arrangement 120 includes only one lamp 55, and in arrangement 120: second and third ballast outputs 1050-1 and 1050-2 are connected to the first lamp terminal of lamp 55, and fourth and fifth ballast outputs 1050-3 and 1050-4 are connected to the second lamp terminal of lamp 55, while first ballast output 1050-0 is not connected to lamp 55 and supplies no current or power to lamp 55.

FIGS. 10-12 described above illustrate three example embodiments of lighting arrangements and associated lamp connection configurations for emergency lighting ballast device 1000, but it should be apparent that several other lamp connection configurations for emergency lighting ballast device 1000 are possible.

Embodiments of emergency lighting ballast devices described above employed parallel-connected capacitor ballasting elements to provide a plurality of selectable ballast outputs for flexible lamp connection configurations for one or more lamps (e.g., fluorescent lamps). However, in similarity to the example of FIG. 2B above, in other embodiments emergency lighting ballast devices may employ series-connected capacitor ballasting elements to provide a plurality of selectable ballast outputs for flexible lamp connection configurations for one or more lamps (e.g., fluorescent lamps).

Figure 13:
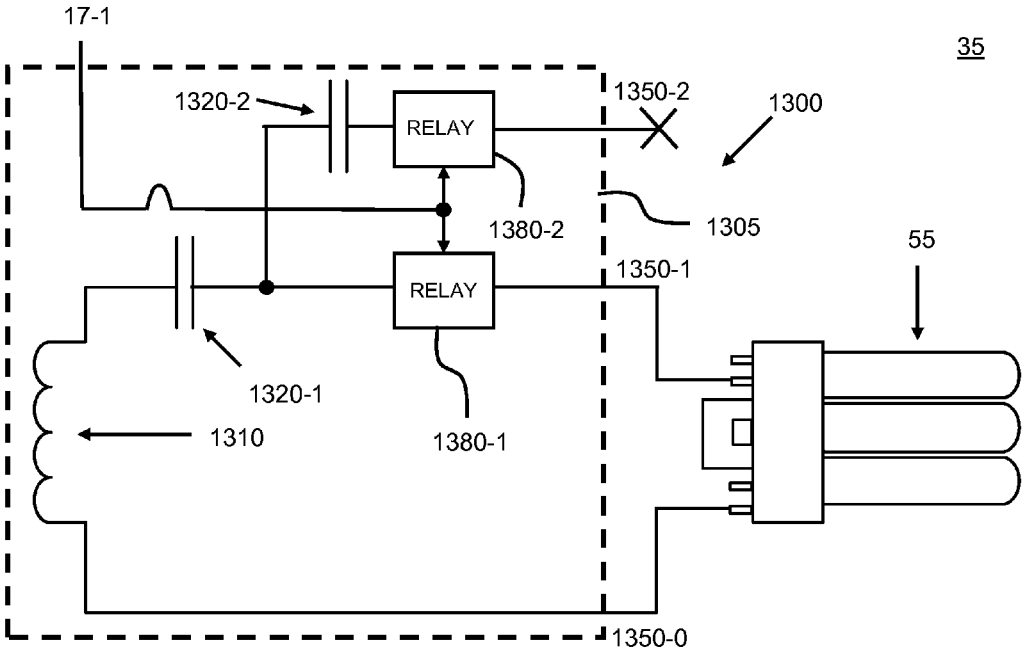
FIG. 13 illustrates a seventh embodiment of a lighting arrangement which includes a fifth embodiment of an emergency lighting ballast device having a plurality of outputs for flexible lamp connection configurations.

FIG. 13 illustrates a seventh embodiment of a lighting arrangement 35 which includes a fifth embodiment of an emergency lighting ballast device 1300 having a plurality of outputs for flexible lamp connection configurations. For simplicity of illustration, only a portion of the ballast of emergency lighting ballast device 1300 is shown in FIG. 13, from a secondary winding 1310 of a ballast transformer to the ballast output. It should be understood that emergency lighting ballast device 1300 may include a number of other components not shown in FIG. 13 (for example, components illustrated in FIG. 1), including a battery, an inverter, a primary winding of the ballast transformer and associated circuitry, etc.

As shown in FIG. 13, emergency lighting ballast device 1300 includes a housing 1305 which contains the secondary winding 1310, a first capacitor 1320-1, a second capacitor 1320-2 and first and second relays 1380-1 and 1380-2. Secondary winding 1310 has first and second ends. First capacitor 1320-1 and second capacitor 1320-2 each have first and second ends, with the first end of first capacitor 1320-1 connected to the first end of the secondary winding 1310, and the second end of first capacitor 1320-1 connected to the first end of second capacitor 1320-2.

Emergency lighting ballast device 1300 has three ballast outputs: a first ballast output 1350-0 which is operatively connected to the second end of the secondary winding 1310 of the transformer; a second ballast output 1350-1 which is operatively connected (via relay 1380-1) to the second end of first capacitor 1320-1; and a third ballast output 1350-2 which is operatively connected (via relay 1380-2) to the second end of second capacitor 1320-2. In some embodiments, each of the first, second and third ballast outputs 1350-0, 1350-1 and 1350-2 may be an insulated wire having an end where the wire may be exposed for connection to a terminal of lamp 55 as desired for a particular lamp connection configuration.

In the arrangement shown in FIG. 3, the first, second, and third ballast outputs 1350-0, 1350-1, and 1350-2 of emergency lighting ballast device 300 have been configured for supplying power to a single lamp 55 (e.g., a fluorescent lamp). In particular, first and second ballast outputs 1350-0 and 1350-1 are connected respectively to first and second lamp terminals of lamp 55, and third ballast output 1350-2 is not connected to lamp 55 and supplies no current or power to lamp 55.

In arrangement 35, during a normal operating mode when AC mains power is available, emergency lighting ballast device 1300 supplies power to lamp 55 from an external power source, and relay 1380-1 is controlled to connect the external voltage received on line 17-1 to lamp 55 (for simplicity of illustration, the control signal for relay 380-1 is omitted in FIG. 3). In an "emergency" mode when AC mains power is lost, relay 380-1 supplies power from the internal ballast of emergency lighting ballast device 300 to lamp 55.

Figure 14:
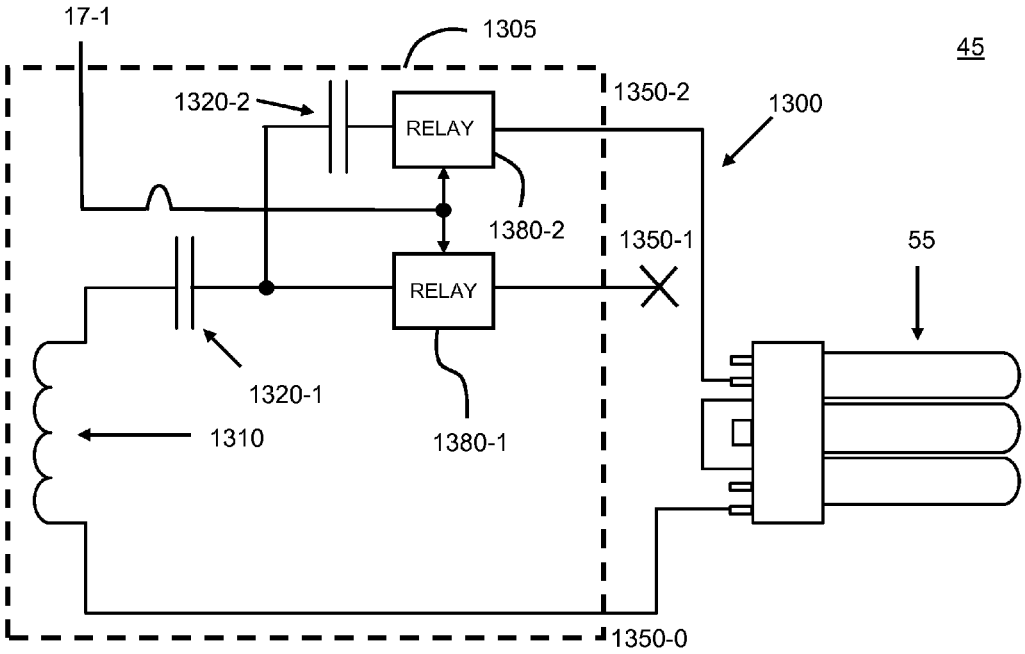
FIG. 14 illustrates an eighth embodiment of a lighting arrangement which includes the fifth embodiment of an emergency lighting ballast device having a plurality of outputs for flexible lamp connection configurations.

FIG. 14 illustrates an eighth embodiment of a lighting arrangement 45 which includes the fifth embodiment of an emergency lighting ballast device 1300 having a plurality of outputs for flexible lamp connection configurations.

In arrangement 45, during a normal operating mode when AC mains power is available, emergency lighting ballast device 1300 supplies power to lamp 55 from an external power source, and relay 1380-2 is controlled to connect the external voltage received on line 17-1 to lamp 55 (for simplicity of illustration, the control signal for relay 1380-2 is not shown in FIG. 14). In an "emergency" mode when AC mains power is lost, relay 1380-2 supplies power from the internal ballast of emergency lighting ballast device 1300 to lamp 55.

The arrangement 45 is similar to the arrangement 35 described above, except that in arrangement 45, third ballast output 350-2 is connected to the second lamp terminal of lamp 55, and second ballast output 1350-1 is not connected to lamp 55 and supplies no current or power to lamp 55. Accordingly, by this configuration emergency lighting ballast device 1300 supplies more power to lamp 55 than in the lighting arrangement 35. That is, the connections of ballast outputs 1350-0, 1350-1 and 1350-2 shown in arrangement 35 may be employed when lamp 55 is a low power lamp, and the connections of ballast outputs 350-0, 350-1 and 350-2 shown in arrangement 45 may be employed when lamp 55 is a high power lamp.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A device, comprising:

a housing;

a circuit disposed within the housing and configured to receive a battery supply voltage and to process the battery supply voltage for driving one or more fluorescent lamps, the circuit comprising at least one transformer and at least two capacitors; and at least three ballast outputs provided at an exterior of the housing, each ballast output being directly connected to a different electrical component of the circuit than the other ballast outputs and being configured to be selectively connected to the one or more fluorescent lamps to supply power from the circuit to the one or more fluorescent lamps, wherein each capacitor of the at least two capacitors is connected in series between the at least one transformer and a corresponding one of the at least three ballast outputs, and wherein the at least one transformer comprises one transformer, including a secondary winding having first and second ends; and wherein the at least two capacitors comprise a first capacitor having a first end connected to the first end of the secondary winding of the transformer, and having a second end; and a second capacitor having a first end connected to the first end of the secondary winding of the transformer, and having a second end; and wherein the at least three ballast outputs comprise:

a first ballast output operatively connected to the second end of the secondary winding of the transformer, a second ballast output operatively connected to the second end of the first capacitor, and a third ballast output operatively connected to the second end of the second capacitor.

2. The device of claim 1, wherein the one or more fluorescent lamps comprise one fluorescent lamp having first and second lamp terminal, wherein the first lamp terminal is connected to the first ballast output, and wherein the second lamp terminal is connected to the second ballast output, and wherein the third ballast output supplies no current to the fluorescent lamp.

3. The device of claim 1, wherein the one or more fluorescent lamps comprise one fluorescent lamp having first and second lamp terminals, wherein the first lamp terminal is connected to the first ballast output, and wherein the second lamp terminal is connected to the second and third ballast outputs, wherein the second and third ballast outputs supply current to the fluorescent lamp.

4. The device of claim 1, wherein the one or more fluorescent lamps comprise first and second fluorescent lamps each having first and second lamp terminals, wherein the first lamp terminal of the first fluorescent lamp is connected to the second ballast output, and wherein the first lamp terminal of the second fluorescent lamp is connected to the third ballast output, wherein the first ballast output is connected to the second lamp terminals of the first and second fluorescent lamps.

5. The device of claim 1, wherein the circuit further comprises at least a third capacitor having a first end connected to one of the first or second end of the secondary winding of the transformer, and having a second end; and wherein the at least three ballast outputs comprise a fourth ballast output operatively connected to the second end of the third capacitor.

6. A device, comprising:

a housing;

a circuit disposed within the housing and configured to receive a battery supply voltage and to process the battery supply voltage for driving one or more fluorescent lamps, the circuit comprising at least one transformer and at least two capacitors; and at least three ballast outputs provided at an exterior of the housing, each ballast output being directly connected to a different electrical component of the circuit than the other ballast outputs and being configured to be selectively connected to the one or more fluorescent lamps to supply power from the circuit to the one or more fluorescent lamps, wherein each capacitor of the at least two capacitors is connected in series between the at least one transformer and a corresponding one of the at least three ballast outputs;

wherein the at least one transformer includes a first secondary winding having first and second ends and a second secondary winding having first and second ends, wherein the second ends of the first and second secondary windings are connected to each other;

wherein the at least two capacitors comprise a first capacitor having a first end connected to the first end of the first secondary winding, and having a second end; and a second capacitor having a first end connected to the first end of the second secondary winding, and having a second end; and wherein the at least three ballast outputs comprise:

a first ballast output operatively connected to the second end of the first secondary winding and the second end of the second secondary winding;

a second ballast output operatively connected to the second end of the first capacitor; and a third ballast output operatively connected to the second end of the second capacitor.

7. The device of claim 6, wherein the one or more fluorescent lamps comprise one fluorescent lamp having first and second lamp terminals, wherein the first lamp terminal is connected to the first ballast output, and wherein the second lamp terminal is connected to the second ballast output, and wherein the third ballast output supplies no current to the fluorescent lamp.

8. The device of claim 6, wherein the one or more fluorescent lamps comprise one fluorescent lamp having first and second lamp terminals, wherein the first lamp terminal is connected to the second ballast output, and wherein the second lamp terminal is connected to the third ballast output, wherein the first ballast outputs supplies no current to the fluorescent lamp.

9. The device of claim 6, wherein the one or more fluorescent lamps comprise first and second fluorescent lamps each having first and second lamp terminals, wherein the first lamp terminal of the first fluorescent lamp is connected to the second ballast output, and wherein the first lamp terminal of the second lamp is connected to the third ballast output, wherein the first ballast output is connected to the second lamp terminals of the first and second fluorescent lamps.

10. The device of claim 6, wherein the at least two capacitors further comprise a third capacitor having a first end connected to the first end of the second secondary winding, and having a second end; and a fourth capacitor having a first end connected to the first end of the second secondary winding, and having a second end; and wherein the at least three ballast outputs further comprise:

a fourth ballast output operatively connected to the second end of the third capacitor; and a fifth ballast output operatively connected to the second end of the fourth capacitor.

11. A device, comprising:

a housing;

a ballast disposed within the housing, wherein the ballast comprises:

one of more secondary windings of one or more transformers, respectively, including a first secondary winding having first and second ends and a second secondary winding having first and second ends, wherein the second ends of the first and second secondary windings are connected to each other; and a plurality of capacitors, each having a first end connected to one of the one or more secondary windings and having a second end, including a first capacitor having a first end connected to the first end of the first secondary winding, and second capacitor having a first end connected to the first end of the second secondary winding; and at least three ballast outputs provided at an exterior of the housing, wherein the at least three ballast outputs include:

a first ballast output operatively connected to at least one of the one or more secondary windings;

a second ballast output operatively connected in series to the second end of the first capacitor and at least one of the one or more secondary windings; and a third ballast operatively connected in series to the second end of the second capacitor and at least one of the one or more secondary windings.

12. The device of claim 11, wherein the at least three ballast outputs are configured to be selectively connected to the one or more lamps to supply power from the circuit to the one or more lamps.

13. The device of claim 11, further comprising a lamp having first and second lamp terminals, wherein the first lamp terminal is connected to the first ballast output, and wherein the second lamp terminal is connected to the second ballast output, and wherein the third ballast output supplies no current to the lamp.

14. The device of claim 11, further comprising a lamp having first and second lamp terminals, wherein the first lamp terminal is connected to the first ballast output, and wherein the second lamp terminal is connected to the second and third ballast outputs, wherein the second and third ballast outputs supply current to the lamp.

15. The device of claim 11, further comprising first and second lamps each having first and second lamp terminals, wherein the first lamp terminal of the first lamp is connected to the second ballast output, and wherein the first lamp terminal of the second lamp is connected to the third ballast output, wherein the first ballast output is connected to the second lamp terminals of the first and second lamps.

16. The device of claim 11, wherein the ballast further comprises:

a third capacitor having a first end connected to the first end of the second secondary winding, and having a second end; and a fourth capacitor having a first end connected to the first end of the second secondary winding, and having a second end; and wherein the at least three ballast outputs further include:

a fourth ballast output operatively connected to the second end of the third capacitor; and a fifth ballast output operatively connected to the second end of the fourth capacitor.

* * * * *